United States Patent [19]

Eastman

[11] Patent Number: 4,651,621

[45] Date of Patent: Mar. 24, 1987

[54] CONTROL SYSTEM FOR AN AIR MOTOR

[75] Inventor: James M. Eastman, South Bend, Ind.

[73] Assignee: Allied Corporation, Morristown, N.J.

[21] Appl. No.: 842,083

[22] Filed: Mar. 20, 1986

[51] Int. Cl.[4] ..... F15B 9/14

[52] U.S. Cl. ..... 91/361; 91/364; 91/454; 91/459; 137/596.16

[58] Field of Search ..... 91/361, 364, 454, 459; 137/625.64, 596.16

[56] References Cited

U.S. PATENT DOCUMENTS

| | | | |
|---|---|---|---|
| 3,119,308 | 1/1964 | Dantowitz | 137/596.18 X |
| 3,294,120 | 12/1960 | Ruchser | 137/596.16 X |
| 4,067,357 | 1/1978 | Ruchser | 137/596.16 |
| 4,075,930 | 2/1978 | Millett | 91/361 |
| 4,386,553 | 6/1983 | Thoman et al. | 91/457 |
| 4,420,014 | 12/1983 | Riggs et al. | 91/446 X |

*Primary Examiner*—Gerald A. Michalsky

*Attorney, Agent, or Firm*—Leo H. McCormick, Jr.; Ken C. Decker

[57] ABSTRACT

A control system (10) for supplying an operational chamber (38) in an air motor with pressurized fluid causing rotors (18 and 20) therein to move and develop an output torque in response to an input signal. Electrically operated valves (52 and 54) selectively controlling the flow of fluid from first and second bellows means (48 and 50) which are normally seated to seal distribution conduit (34 and 36) connecting the operational chamber (38) to the atmosphere. A select high disc valve (104) in the fluid pressure supply passage provides operating fluid to the distribution conduit (34 or 36) opposite the one which is vented to the atmosphere. In a two position air motor powered actuator, the electrical signals for the valves (52 and 54) may be derived as a simple function of actual rotor rotation and rotor rotational speed. As the total number of rotations approaches a set number, the scheduled rotational speed approaches zero, and the signal to the valves (52 and 54) terminates and allows the bellows means (48 and 50) to reseal the distribution conduit (34 or 36) as needed to stop rotor motion or slow it enough to assure stop engagement without excessive impact force. For other actuator applications, the signals to valves (52 and 54) may be provided by control means as used for a doser actuator piston controller (Reference U.S. Pat. No. 4,386,553).

7 Claims, 3 Drawing Figures

CONTROL SYSTEM FOR AN AIR MOTOR

This invention relates to an electrical system for controlling the operation of an air motor. The flow of the operational fluid through an operational chamber is controlled by first and second solenoid valves which respond to an operational signal from a comparator. The comparator has an operational input which represents the actual number of revolutions or the speed of the rotor in the air motor. The operational input is compared with an operational schedule and from this evaluation the operational signal is generated to provide the required flow of operational fluid to produce an output torque as needed to make the operational input signal correspond to the operational schedule.

Pneumatic actuators have been developed to control the operation of air motors. U. S. Pat. No. 4,420,014 disclosed structure wherein a variable reference signal is used to control the operational fluid supplied to a motor. The regulator has an input that represents the work performed by the motor. When this input reaches a predetermined value, a relief valve opens and the supply pressure is modified to protect any mechanism operated by the motor from receiving any excessive torque. While this type of control is satisfactory, the various components that make up the structure require many machining operations and the time of response may not be fast enough to meet current specifications for all uses.

In the invention disclosed herein the mechanical components in the prior art regulators have been replaced with a pair of solenoid valves that are periodically activated by an electrical signal derived by comparing the actual number of revolutions or speed of a rotor with a schedule in a function generator. The solenoid valves control the flow of fluid from control chambers formed by first and second bellows. Each control chamber is connected to a source of operational fluid under pressure. With the control chambers in communication with the source of operational fluid, the first and second bellows expand and close first and second exit ports in a distribution conduit connected to an operational chamber.

In response to an operational signal, an electronic controller or computer sends a pulse generator, a signal which in turn supplies one of the solenoid valves with an electrical input signal. This electrical input signal activates a selected solenoid valve which allows the operational fluid in the associated control chamber to flow into the surrounding environment. As the operational fluid flows from the control chamber, the bellows means moves away from the exit port in the distribution conduit to allow operational fluid to flow from the supply chamber through the distribution conduit to the operational chamber to rotate the rotor before flowing to the surrounding environment through the opened exit port. In a simple controller embodiment adapted for two position actuators wherein many revolutions correspond to the actuator stroke, a first counter generates a scheduled speed signal as a function of the number of rotor revolutions while a second counter generates an actual speed signal from the rotor movement. A summing means generates an error signal from the schedule speed signal and the actual speed signal. A function generator responsive to the error signal generates the electrical input signal which activates the selected solenoid valve. When the rotor approaches the predetermined number of revolutions corresponding to full actuator stroke, the scheduled speed signal from which the error signal is derived is designed to approach zero such that the function generator terminates the electrical input signal and the solenoid valve closes to permit the operational fluid pressure to build up in the control chamber and move the bellows means to close the exit port. Thereafter the fluid pressure stabilizes in the distribution conduit and the rotor driving torque terminates. If an external load torque acts to rotate the rotor faster than the scheduled speed, the function generator acts on the appropriate solenoid valve to apply opposing pressure to the operational chamber as needed.

When an air motor driven actuator is operated to provide continuous closed loop positioning of a valve or other device to regulate a parameter such as position, flow, or pressure, the necessary electrical pulses to the solenoid valve can be supplied using a control operation as described in U.S. Pat. No. 4,386,553.

An advantage of this invention occurs through the use of simple and inexpensive solenoid control valves which receive commands from a computer to operate an air motor.

A further advantage of this invention occurs since only the exhaust ports are directly controlled by the solenoid valve arrangements.

Another advantage of this invention is its use of poppet type control valves which are essentially leak proof, thereby conserving operational fluid and improving performance.

A still further advantage of this invention resides in the fact that one supply port is always connected to the supply of operational fluid while the fluid pressure in other ports is only lowered as required to overcome an applied load. This type of arrangement minimizes the compressibility effects of the operational fluid and provides for a faster rotor response to the operation of the solenoid operated control valves.

An object of this invention is to provide a simple and inexpensive means for operating an air motor driven actuator with commands from a digital computer.

A further object of this invention is to provide a simple electronic controller for use in establishing two position actuation of an air motor.

These advantages and objects should be apparent from reading this specification while viewing the drawings wherein.

Figure 1:
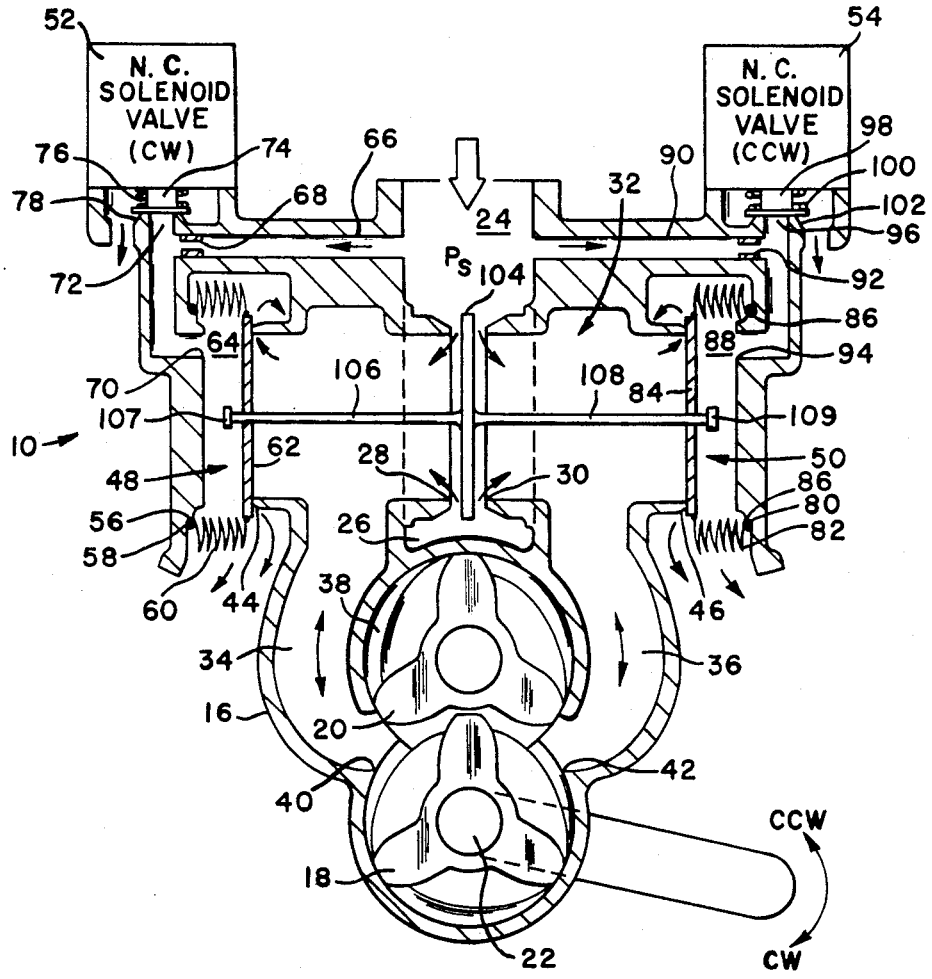
FIG. 1 is a sectional view of a control system made according to this invention through which an air motor is supplied with operational fluid in response to electrical signals.

The control system 10 shown in FIG. 1 is connected to the housing 16 of an air motor. In response to an input signal the rotors 18 and 20 provide either a clockwise or counterclockwise torque to rotate shaft 22.

The control system 10 includes supply chamber 24 connected to a source of fluid under pressure. This supply fluid is normally compressor discharge fluid that is bled off the engine and can often have a temperature of 500° C. and a fluid pressure which varies from 0 psig to 600 psig.

An annular distribution passage 26 which extends from the supply chamber 24 provides a continuous flow path for the operational fluid to first and second supply ports 28 and 30 that feed the distribution conduits 34 and 36 connected to an operational chamber 38.

The first distribution conduit 34 has an exit port 44 which is connected to the surrounding environment and the second distribution conduit 36 has an exit port 46 which is connected to the surrounding environment.

The distribution conduits 34 and 36 are designed such that the operational fluid can flow in either one or the other to provide the motive force for rotating rotors 18 and 20. The flow of the operational fluid in the distribution conduits is controlled by first and second bellows means 48 and 50, that respond to the control signals supplied to either solenoid valve 52 or 54.

The first bellows means 48 has an annular bead 56, a flexible section 60 and a face member 62. When bead 56 is located in groove 58 a first control chamber 64 is established. The control chamber 64 is connected to the supply chamber 24 by a supply conduit 66. A restrictive orifice 68 located in the supply conduit 66 controls the rate at which the operational fluid flows through opening 70 into control chamber 64. The supply conduit 66 has an opening 72 which is located between opening 70 and the restrictive orifice 68. Solenoid valve 52 has a plunger 74 that is urged by spring 76 into engagement with seat 78 surrounding opening 72.

Similarly the second bellows means 50 has an annular bead 80, a flexible section 82 and a face member 84. When bead 80 is located in groove 86, a second control chamber 88 is established. The control chamber 88 is connected to the supply chamber 24 by a supply conduit 90. A restrictive orifice 92 located in the supply conduit 90 controls the rate at which the operational fluid flows through opening 94 into control chamber 88. The supply conduit 90 has an opening 96 located between restrictive orifice 92 and opening 94. Solenoid valve 54 has a plunger 98 that is urged by spring 100 into engagement with seat 102 surrounding opening 96.

A floating disc valve 104 has a central section with a first shaft 106 that extends through the first face member 62 and a second shaft 108 that extends through the second face member 84. The first and second shafts 106 and 108 which are free to move with respect to the first and second face members 62 and 84, respectively, are limited by buttons 107 and 109. Without a load on the rotors 18 and 20, the fluid pressure in the distribution conduits 34 and 36 should be the same and the floating disc 104 should be centered between the annular lips of openings 28 and 30. As long as the solenoids 52 and 54 remain in the inactivated state, components in the control system remain in substantially the positions shown in FIG. 1.

In operation, high pressure fluid is communicated to the supply chamber 24 and distributed by the distribution conduits 34 and 36 to the operational chamber 38. The effective area of the first and second bellows means 48 and 50 is about twice the effective area of the exit ports 44 and 46 respectively. Restricted orifices 68 and 92 in supply conduits 66 and 90 allow high pressure operational fluid to flow to chambers 64 and 88 and expand the flexible sections 60 and 82 such that face members 62 and 84 engage seats surrounding openings 44 and 46 respectively.

The desired direction of the rotational torque, either clockwise or counterclockwise, is a function of which solenoid valve 52 or 54 is activated. Since the operation of the solenoid valves 52 and 54 and the resulting flow of operational fluid through the operational chamber 38 is the same with the exception of the direction of the flow, only the operation of the clockwise rotation will be described in detail.

In response to an electrical signal, solenoid valve 52 is activated causing plunger 74 to move away from seat 78 and allowing the operational fluid in chamber 64 to flow to the surrounding environment. When the fluid pressure in chamber 64 falls below approximately one-half the supply pressure, the pressure differential across face member 62 causes the flexible section 60 to collapse and vent distribution conduit 34 to the surrounding environment. With distribution conduit 34 at a lower fluid pressure than distribution conduit 36, a small pressure differential is created across the floating disc valve 104. This pressure differential causes the disc valve to close port 28 and to fully open port 30.

By cutting off fluid supply pressure to distribution conduit 34, disc valve 104 immediately increases the pressure difference between conduits 34 and 36 causing a fast snap action and developing a high rotor torque in operational chamber 38. The rotors accelerate output shaft 22 in a clockwise direction until the increasing pressure drops through valve openings 30 and 44 reduce the pressure differential across the operational chamber and the corresponding rotor torque enough to just balance the external load. To provide for substantially immediate action of the disc valve 104 when a reversal of the rotor is desired, the bellows face 62 engages end 107 on shaft 106 to assure that disc 104 is pulled away from surrounding opening 30 and to the mid position shown in FIG. 1 when the exit port 44 is opened to the surrounding environment. When the bellows means 48 and 50 are pressurized by the operational fluid in control chambers 64 and 88, faces 62 and 84 engage surrounding exit ports 44 and 46 to seal the distribution conduits 34 and 36. With both exit ports 44 and 46 closed or sealed, the floating disc valve 104 is free to move to close off either supply port 28 or 30 in response to a small pressure differential in the first and second distribution conduits 34 and 36. Thus, while the null condition does not lock shaft 22, any external load can only move the shaft slowly as a result of rotors 18 and 20 having to pump down the fluid pressure in one branch while the other branch receives the pressure of the supply or operational fluid. The speed at which the rotors 18 and 20 can turn depends on clearances, the supply fluid pressure and applied load.

Typically, the solenoid valves 52 and 54 are pulsed at periodic sampling intervals to provide corresponding motor movements. The pulses are essentially proportional to position error so that the average valve opening and the speed of error correction are also essentially proportional to position error, as for an integrating style proportional controller. The rotors 18 and 20 typically make many revolutions per actuator stroke. Reduction gearing and/or screw threads are used to convert revolutions of shaft 22 to the desired output stroke.

When the load is uniformly in one direction, whether opposing or overhauling, the disc valve 104 remains in one position while the solenoid valve 52 or 54 controls speed of error correction. For opposing load, the supply disc valve 104 vents pressure to the side opposite the controlling solenoid valve to provide motor torque. For overhauling loads, supply pressure is vented to the same side so that the motor acts as a pump to provide braking torque.

Figure 3:
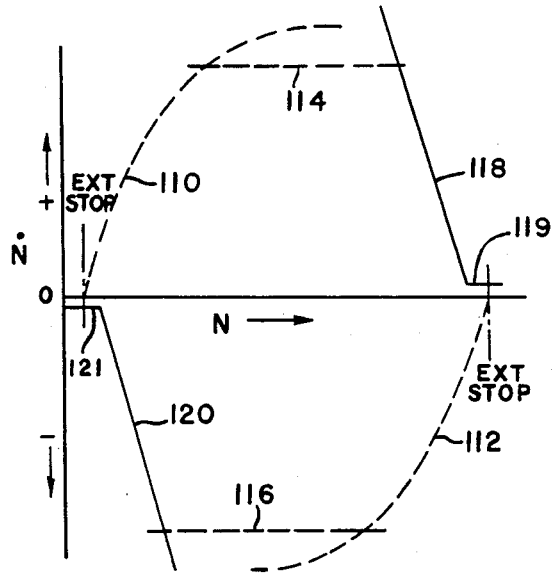
FIG. 3 is a schematic illustration of the velocity of the rotor in relation to the number of revolutions for the system of FIG. 2.

Many air motor drive actuators such as disclosed in U.S. Pat. No. 4,442,928 are essentially operate in only two position. Such actuators are normally required to stroke from one position stop to another stop as rapidly as possible, but without engaging the stop at the end of the stroke at such a high enough speed which causes excessive impact loading. In the case of thrust reversers, a brake or clamp is normally used to hold the actuator against the stop at the end of the stroke, and the air pressure is turned off until reverse stroking is needed. FIG. 3 illustrates a typical two position operation for an actuator. Lines 110 and 112 represent normal acceleration capability of the rotors 18 and 20 (one solenoid valve continuously energized), horizontal lines 114 and 116 represent a limitation that may be placed on the rotor velocity either for structural or bearing life considerations, and lines 118 and 120 represent scheduled deceleration of the rotors 18 and 20 to arrive at low speed plateaus 119 and 121 once a predetermined number of revolutions have been made.

Figure 2:
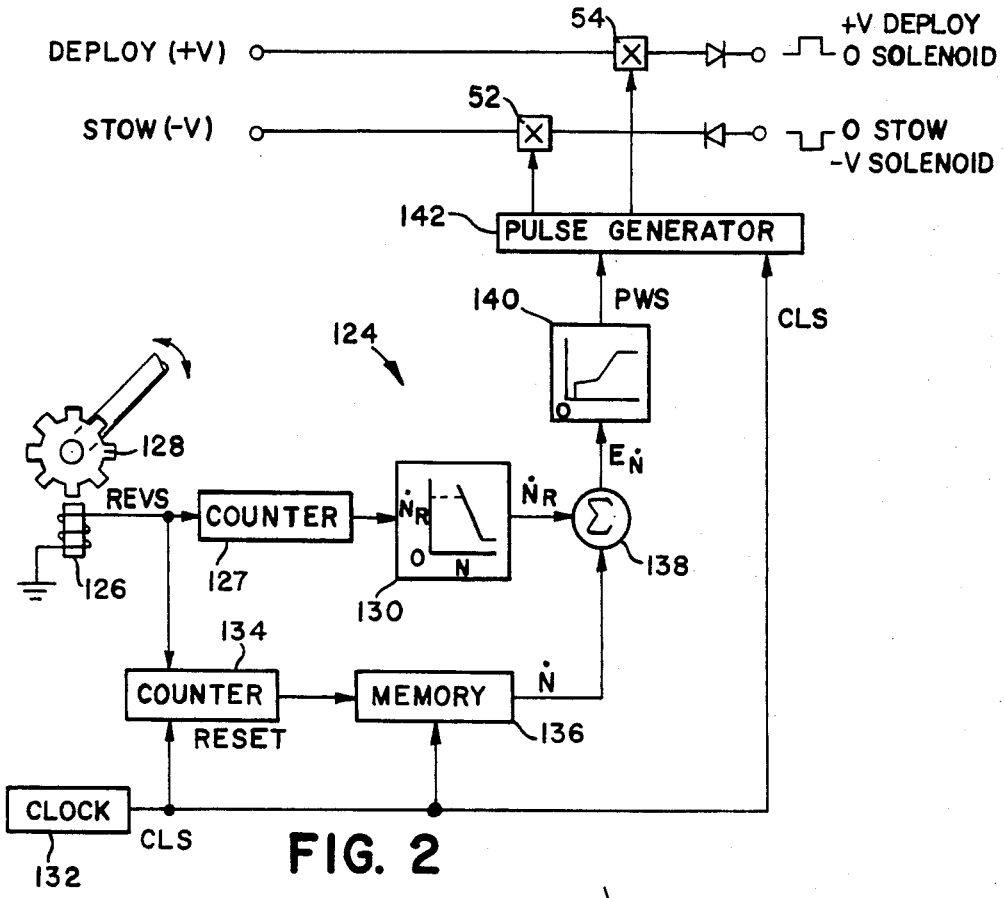
FIG. 2 is a schematic illustration of an electrical circuit for supplying solenoid operated valves in the control system with operational signals for air motor driven two position actuators.

FIG. 2 illustrates the simple electronic controller 124 for operating solenoids 52 and 54 when a two position actuator (e.g. for a thrust reverser) is the recipient of the output of shaft 22. A conventional motor rotation pick-up coil 126 acts with a toothed wheel 128 on shaft 22 to provide a pulse count N, reflecting motor rotation. A function generator 130 schedules the desired pulse rate $\acute{N}r$ (rotor speed) as a function of N as in FIG. 3. A clock 132 generates a periodic sampling interval pulse CLS. A second counter 134 for N is periodically reset by the clock signal CLS. The count achieved per sampling interval reflects actual rotor speed and is stored in memory 136 until up-dated by another clock pulse CLS. The latest value of $\acute{N}$ is compared with $\acute{N}r$ in a summing means 138 to develop speed error signal $E\acute{N}$. A second function generator 140 schedules the needed pulse width PWS, as a function of $E\acute{N}$ and continuously supplies the pulse generator 142 with the PWS signal. For each clock pulse CLS, the pulse generator 142 delivers a voltage pulse of a duration scaled to the PWS signal. The polarity of the output pulse is controlled by the choice electrical voltage switching and determines which solenoid valve 52 or 54 is activated and which direction the actuator moves.

For thrust reverser actuation, electricity is initially off, air pressure to the supply conduit or chamber 24 is off and the actuator is clamped and against one of the travel stops. By selecting actuation of the thrust reverser (either to deploy or stow), electrical power is supplied to the controller 124 which immediately starts counting rotational motion pulses N and measuring N. Initially a large speed error $E\acute{N}$ exists calling for a saturated pulse width signal PWS (equal to the sampling interval). The appropriate solenoid valve 52 or 54 opens and stays open until actuator speed N approaches the scheduled value $\acute{N}r$. The reduction in speed error signal $E\acute{N}$ than reduces pulse width signals PWS as required to limit rotor speed to the scheduled value. The rotors 18 and 20 decelerate according to the schedule as set forth in FIG. 3 and engage the stop at the end of the stroke at the required slow speed. Thereafter, the electrical power is turned off, the supply of operative fluid is shut off, and the rotor shaft is clamped in position ready for the return stroke.

If the actuator needs only internal stroke limiting the low speed plateau 119 and 121 shown for stop engagement (FIG. 3) could be shortened or dispensed with and uniform deceleration provided. The pulse counter 127 does not provide an absolute position indication, but rather net travel since the power was turned on (independent of direction). Thus, the actuator must engage the stops under load and be clamped and the power shut off, so that the pulse counter 127 is always reset in readiness for the return stroke.

Thus, this invention provides for the control of an air motor through the use of solenoids 52 and 54 whose actuation is controlled by inputs supplied by a pulse generator 142 and which in turn control the output torque generated by operational fluid pressure acting on rotors 18 and 20.

I claim:

1. A control system for supplying an operational chamber with pressurized fluid causing a rotor therein to develop an output torque in response to an input signal, comprising:

a housing having a supply chamber for receiving operational fluid from a source having a fluid pressure, said supply chamber having first and second supply ports, said first and second supply ports being connected to said operational chamber by first and second distribution conduits, said distribution conduits having corresponding first and second exit ports connected to the surrounding environment;

first bellows means connected to said housing to define a first control chamber, said first control chamber receiving operational fluid from said supply chamber, said operational fluid moving said first bellows means toward said first exit port to control the flow of operational fluid from said first distribution conduit, said housing having a first control port for connecting said first control chamber with the surrounding environment;

second bellows means connected to said housing to define a second control chamber, said second control chamber receiving operational fluid from said supply chamber, said operational fluid moving said second bellows means toward said second exit port to control the flow of operational fluid from said second distribution conduit, said housing having a second control port for connecting said second control chamber with the surrounding environment;

valve means for selectively controlling the flow of operational fluid through said first and second supply ports into said first and second distribution conduits, said valve means being arranged to direct the flow of operational fluid into the distribution conduit having the higher pressure;

electronic means having a first solenoid valve associated with said first control port, a second solenoid valve associated with said second control port, first counter means for generating a scheduled speed signal as a function of the rotation of said rotor, second counter means for generating an actual speed signal as a function of the rotation of said rotor, sensing means for generating an error signal as a function of the scheduled speed signal and the actual speed signal, function generator means responsive to said error signal for generating a pulse width signal, and generator means for providing said first and second solenoids with said electrical signal as a function of said pulse width signal, said first and second solenoid valves being responsive to said electrical signal for opening one or the other of said first and second control ports for allowing operational fluid to flow from the corresponding control chamber and thereby produce a pressure differential which moves the bellows means from the associated exit port to permit the operational fluid to flow from the corresponding distribution conduit to the surrounding environment and allow said valve means to direct the supply fluid to the other distribution conduit and establish the rotational direction of the rotor to develop said output torque, said electronic means on termination of said input signal closing the opened first or second control port to allow the fluid pressure in the operational fluid to move the associated bellows means and close the exit port to interrupt the flow of operational fluid from said distribution conduit and to substantially terminate the rotation of the rotor as the fluid pressure throughout the entire distribution conduit returns to essentially the fluid pressure in the operational fluid at the source; and slidable means connecting to said first and second bellows means so that opening of said associated exit port by said first and second bellows means causes said valve means to open said corresponding first or second supply port at least about half way and thereby initiate the direction of flow of the operational fluid to the operational chamber.

2. The control system as recited in claim 1 wherein said valve means includes:

a centrally located disc member having a first face and a second face, said first face engaging said housing adjacent said first supply port to direct operational fluid through said second supply port and said second face engaging said housing adjacent said second supply port to direct operational fluid through said first supply port; and linkage means for connecting said disc member with said first and second bellows means, said linkage means allowing said disc member to move independently of said first and second bellows means when these are positioned for closing said first and second exit ports.

3. The control system as recited in claim 2 wherein said first and second bellows means each includes:

a bead member located in a groove in said housing and a face section, said face section being connected to said bead member by a flexible section, said flexible section having an effective area about twice the area of the corresponding exit port such that when the fluid pressure in the control chamber is above one-half the fluid pressure in the operational fluid the face section moves toward and engages the housing surrounding the exit port.

4. The control system as recited in claim 3 wherein said disc member moves freely between the first and second supply ports when said first and second bellows means are seated on the housing surrounding the first and second exit ports to seat on said first or second supply port connected to said first or second distribution conduit having the lower pressure, thereby causing the rotor to pump operational fluid through the clearance spaces around said rotor in response to any load torque applied to it and limiting rotational speed to low value.

5. A control system for supplying an operational chamber with pressurized fluid causing a rotor therein to develop torque in response to an input signal, comprising:

a housing having a supply chamber for receiving operational fluid from a source having a fluid pressure, said supply chamber having first and second supply ports, said first and second supply ports being connected to said operational chamber by first and second distribution conduits, said distribution conduits having corresponding first and second exit ports connected to the surrounding environment;

first bellows means connected to said housing to define a first control chamber, said first control chamber receiving operational fluid from said supply chamber, said operational fluid moving said first bellows means toward said first exit port to control the flow of operational fluid from said first distribution conduit, said housing having a first control port for connecting said first control chamber with the surrounding environment;

second bellows means connected to said housing to define a second control chamber, said second control chamber receiving operational fluid from said supply chamber, said operational fluid moving said second bellows means toward said second exit port to control the flow of operational fluid from said second distribution conduit, said housing having a second control port for connecting said second control chamber with the surrounding environment;

valve means for selectively controlling the flow of operational fluid through said first and second supply ports into said first and second distribution conduits, said valve means being arranged to direct the flow of operational fluid into the distribution conduit having the higher pressure;

slidable means extending from said valve means and connected to said first and second bellows means; and electronic means responsive to an electrical signal for opening one or the other of said first and second control ports for allowing operational fluid to flow from the corresponding control chamber and thereby produce a pressure differential which moves the bellows means to open the associated exit port, said movement of said bellows causing said valve means to open at least half way and permit the operational fluid to flow from the corresponding distribution conduit to allow said valve means to direct the supply fluid to the other distribution conduit for developing said output torque, said electronic means on termination of said input signal closing the opened first or second control port to allow the fluid pressure in the operational fluid to move the associated bellows means and close the exit port to interrupt the flow of operational fluid from said distribution conduit and to substantially terminate the rotation of the rotor as the fluid pressure throughout the entire distribution conduit returns to essentially the fluid pressure in the operational fluid at the source, said slidable means allowing said valve means to sequentially move to a null position as the pressure differential between said first and second distribution conduits terminates.

6. The control system as recited in claim 5 wherein said electronic means includes:

a first solenoid valve associated with said first control port; and a second solenoid valve associated with said second control port, said first and second solenoid valves responding to said electrical signal to control the flow of operational fluid from said first or second control chamber to the surrounding environment and the associated second and first supply ports to establish the rotational direction of the rotor.

7. The control system as recited in claim 6 wherein said electronic means includes:

first counter means for generating a scheduled speed signal as a function of the rotation of said rotor;

second counter means for generating an actual speed signal as a function of the rotation of said rotor;

sensing means for generating an error signal as a function of the scheduled speed signal and the actual speed signal;

function generator means responsive to said error signal for generating a pulse width signal; and generator means for providing said first and second solenoids with said electrical signal as a function of said pulse width signal.

* * * * *